US009033261B2

(12) United States Patent
Zhou et al.

(10) Patent No.: US 9,033,261 B2
(45) Date of Patent: May 19, 2015

(54) SINGLE POINT TOUCH SHOWER

(75) Inventors: Huasong Zhou, Xiamen (CN); Hexian Cai, Xiamen (CN); Jianmin Chen, Xiamen (CN); Bin Chen, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 266 days.

(21) Appl. No.: 13/521,102

(22) PCT Filed: Jan. 10, 2011

(86) PCT No.: PCT/CN2011/070143

§ 371 (c)(1),
(2), (4) Date: Jul. 9, 2012

(87) PCT Pub. No.: WO2011/085667

PCT Pub. Date: Jul. 21, 2011

(65) Prior Publication Data

US 2013/0015269 A1 Jan. 17, 2013

(30) Foreign Application Priority Data

Jan. 15, 2010 (CN) ..... 2010 1 0005537
Jan. 15, 2010 (CN) ..... 2010 2 0004362 U

(51) Int. Cl.

| | |
|---|---|
| ***A62C 31/00*** | (2006.01) |
| ***B05B 1/16*** | (2006.01) |
| ***B05B 12/00*** | (2006.01) |
| *B05B 1/18* | (2006.01) |

(52) U.S. Cl.

CPC ..... *B05B 1/1636* (2013.01); *B05B 1/169* (2013.01); *B05B 1/18* (2013.01); *B05B 12/002* (2013.01)

(58) Field of Classification Search
None
See application file for complete search history.

(56) References Cited

U.S. PATENT DOCUMENTS

| | | | | |
|---|---|---|---|---|
| 4,754,928 | A * | 7/1988 | Rogers et al. | 239/381 |
| 2005/0258274 | A1 | 11/2005 | Wang | |
| 2008/0017735 | A1 | 1/2008 | Zhou | |
| 2009/0321538 | A1 * | 12/2009 | Lo | 239/443 |

FOREIGN PATENT DOCUMENTS

| | | | |
|---|---|---|---|
| CN | 101428258 | A | 5/2009 |
| CN | 101767069 | A | 7/2010 |
| CN | 201659037 | U | 12/2010 |

* cited by examiner

*Primary Examiner* — Len Tran
*Assistant Examiner* — Adam J Rogers
(74) *Attorney, Agent, or Firm* — Rabin & Berdo, P.C.

(57) ABSTRACT

A single point touch shower has a fixed unit, an outlet terminal and a switching mechanism. The fixed unit has an inlet passage connecting the water resource; the outlet terminal is asway connected to the fixed unit and provided with a plurality of outlet functions; the switching mechanism comprises a first ratchet wheel, a stopping claw and a transmission mechanism; the first ratchet wheel is rotationally connected to the outlet terminal; the stopping claw connects the first ratchet wheel and the fixed unit to limit the reversal of the first ratchet wheel; the transmission mechanism connects the first ratchet wheel and the fixed unit to transmit the mutual swing between the outlet terminal and the fixed unit to the relative rotation between the first ratchet wheel and the outlet terminal, and the outlet functions switching is controlled through the relative rotation between the first ratchet wheel and the outlet terminal.

11 Claims, 19 Drawing Sheets

SINGLE POINT TOUCH SHOWER

FIELD OF THE INVENTION

The present invention relates to a swing switch shower, and more particularly to a single point touch shower.

BACKGROUND OF THE INVENTION

The swing switching process of the swing switching shower at the prior art is described below: the force of the users acts on the first part of the shower, so that the shower swings to the first direction and water comes out of the first outlet function; the force of the users acts on the second part of the shower, so that the shower swings to the second is direction and water comes out of the second outlet function. According to the description above, a plurality of defects are present in the swing switching shower at the prior art: 1 the corresponding outlet function mark has to be processed at the first part or the second part of the shower; 2 different outlet functions are achieved through different swing directions, so that the structure of the switching mechanism is complicated with large space occupation.

SUMMARY OF THE INVENTION

The object of the present invention is to offer a single point touch shower, which overcomes the defects of the swing switch shower at the prior art.

The technical proposal to solve the technical matters in the present invention is:

Single point touch shower, it comprises:

A fixed unit, which is provided with a inlet passage connecting the water resource;

An outlet terminal, which is asway connected to the fixed unit and provided with a plurality of outlet functions;

And a switching mechanism, which comprises a first ratchet wheel, a stopping claw and a transmission mechanism; the first ratchet wheel is rotationally connected to the outlet terminal; the stopping claw connects the first ratchet wheel and the fixed unit to limit the reversal of the first ratchet wheel; the transmission mechanism connects the first ratchet wheel and the fixed unit to transmit the mutual swing between the outlet terminal and the fixed unit to the relative rotation between the first ratchet wheel and the outlet terminal, and the switching of outlet functions is controlled through the relative rotation between the first ratchet wheel and the outlet terminal.

In a preferred embodiment, the running through outlet openings are open up on the first ratchet wheel, the communication between the outlet openings and the outlet passage and one of the outlet functions is controlled through the mutual rotation between the first ratchet wheel and the outlet terminal.

In a preferred embodiment, a return spring is arranged between the fixed unit and the outlet terminal to reset the swing of the outlet terminal.

In a preferred embodiment, a downward contact is fixed in the fixed unit;

The transmission mechanism comprises:

An actuator, which is coupling with the contact, so that the contact can drive the positive rotation and the reversal of the actuator when the outlet terminal is swinging relative to the fixed unit;

A clutch mechanism, which connects the actuator and the first ratchet wheel, so that the first ratchet wheel can rotate positively when the actuator rotates positively, or the first ratchet wheel can stop when the actuator is reversing.

In a preferred embodiment, the actuator comprises a second ratchet wheel and an extended part fixedly connected to the second ratchet wheel, and the extended part is coupling with the contact, and the clutch mechanism is connected between the second ratchet wheel and the first ratchet wheel.

In a preferred embodiment, the clutch mechanism comprises a first inner ratchet opened in the first ratchet wheel, a second inner ratchet opened in the second ratchet wheel and a clutch ratchet, the clutch ratchet connects the first inner ratchet and the second inner ratchet; the first ratchet wheel is provided with the outer ratchet coupling with the stopping claw.

In a preferred embodiment, the fixed unit comprises a inlet body and, a spring seat fixedly connected out of the inlet body, a hollow hole is formed in the inlet body; the outlet terminal comprises a body and a outlet mechanism, the body is hermetically sleeved out of the inlet body and asway supports above the spring seat, the outlet mechanism is fixedly connected under the body; the spring is mounted on the spring seat and against the body.

In a preferred embodiment, the outlet terminal also comprises a support seat which is fixedly arranged on the outlet mechanism; the first ratchet wheel comprises a base plate and a convex shaft fixedly arranged on the base plate, the outer ratchets are arranged on the outer rotative surface of the base plate, the first inner ratchet is arranged on the end face of the convex shaft, the base plate is located between the support seat and the outlet mechanism, the convex shaft is pivotally connected to the support seat.

In a preferred embodiment, the second ratchet wheel is pivotally connected to the support seat, the upper part of the clutch ratchet is connected to the second ratchet of the second inert ratchet wheel, the lower part of the clutch ratchet is connected to the first inner ratchet of the first ratchet wheel.

In a preferred embodiment, the inlet passage comprises the hollow hole, the inlet cavity communicating with the hollow hole is formed between the body and the outlet mechanism.

In a preferred embodiment, the mark is arranged on the body of the outlet terminal, the users touch the mark of the body or its surrounding place with single point, and then the outlet terminal swings relative to the fixed unit.

Compared with the mechanism at the prior art, the advantages of the present invention are:

1 Because the ratchet wheel is introduced in the switching mechanism of the swing switching shower, the switching of different outlet functions can be achieved by the one-way rotation of the ratchet wheel, and the one point touch switching, the switching of outlet functions and the rotation switching are achieved with simplified switching mechanism and low space occupation;

2 the clutch mechanism is introduced in the transmission mechanism, making sure that the first ratchet wheel does not reverse during the swinging resetting process;

3 The stopping claw coupling with the ratchet wheel makes sure the maintaining of the switching of the outlet functions;

4 The clutch is achieved through the coupling of the clutch ratchet, the first inner ratchet and the second inner ratchet with simple structure and good stability;

5 The spring seat is not only used for supporting the body, but also used for mounting the spring;

6 The spring is arranged on the spring seat and against the body, making sure enough swinging resetting force.

BRIEF DESCRIPTION OF THE DRAWINGS

With the following description of the drawings and specific embodiments, the invention shall be further described in details.

DESCRIPTION OF THE PREFERRED EMBODIMENTS

Figure 1:
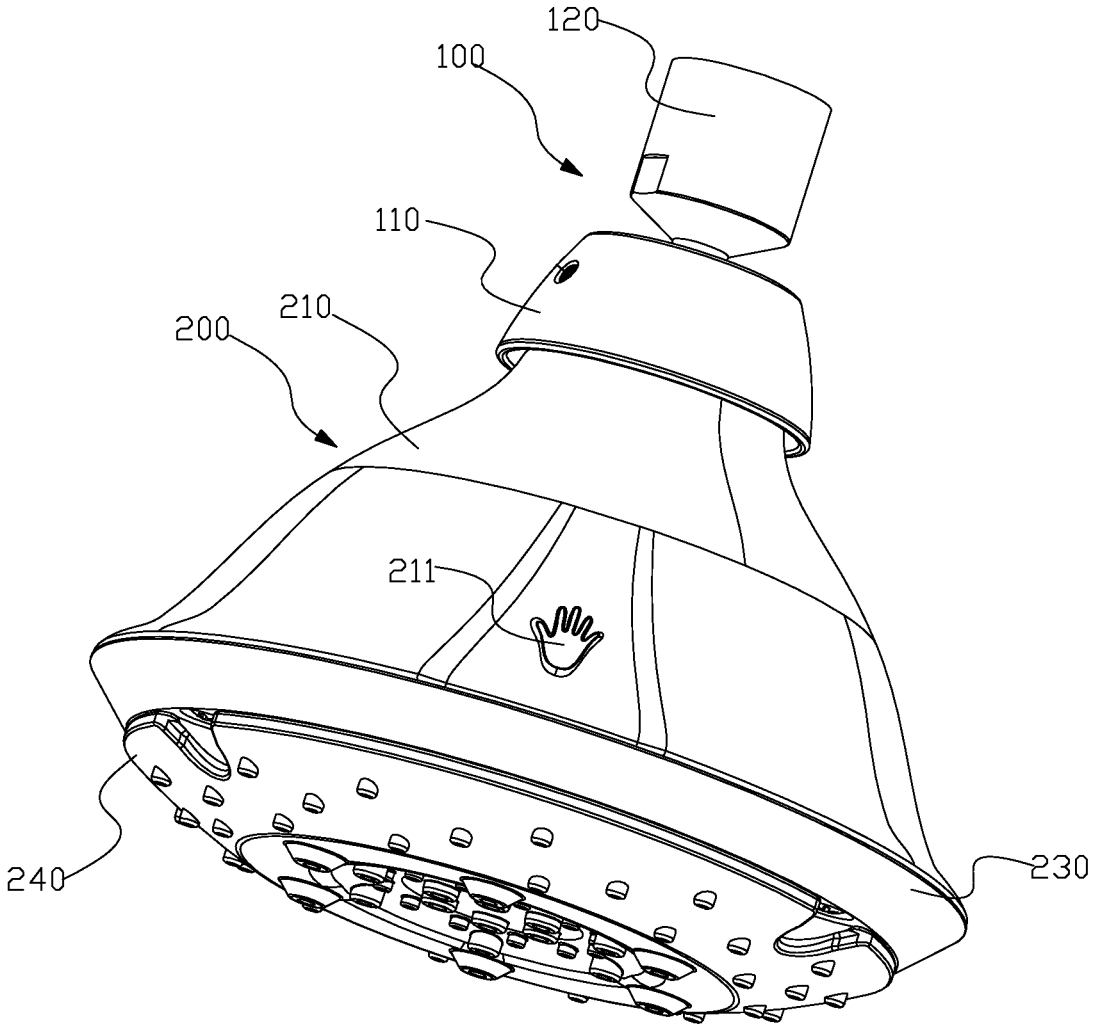
FIG. 1 shows the solid abridged general view of the single point is touch shower in the present invention.
Figure 2:
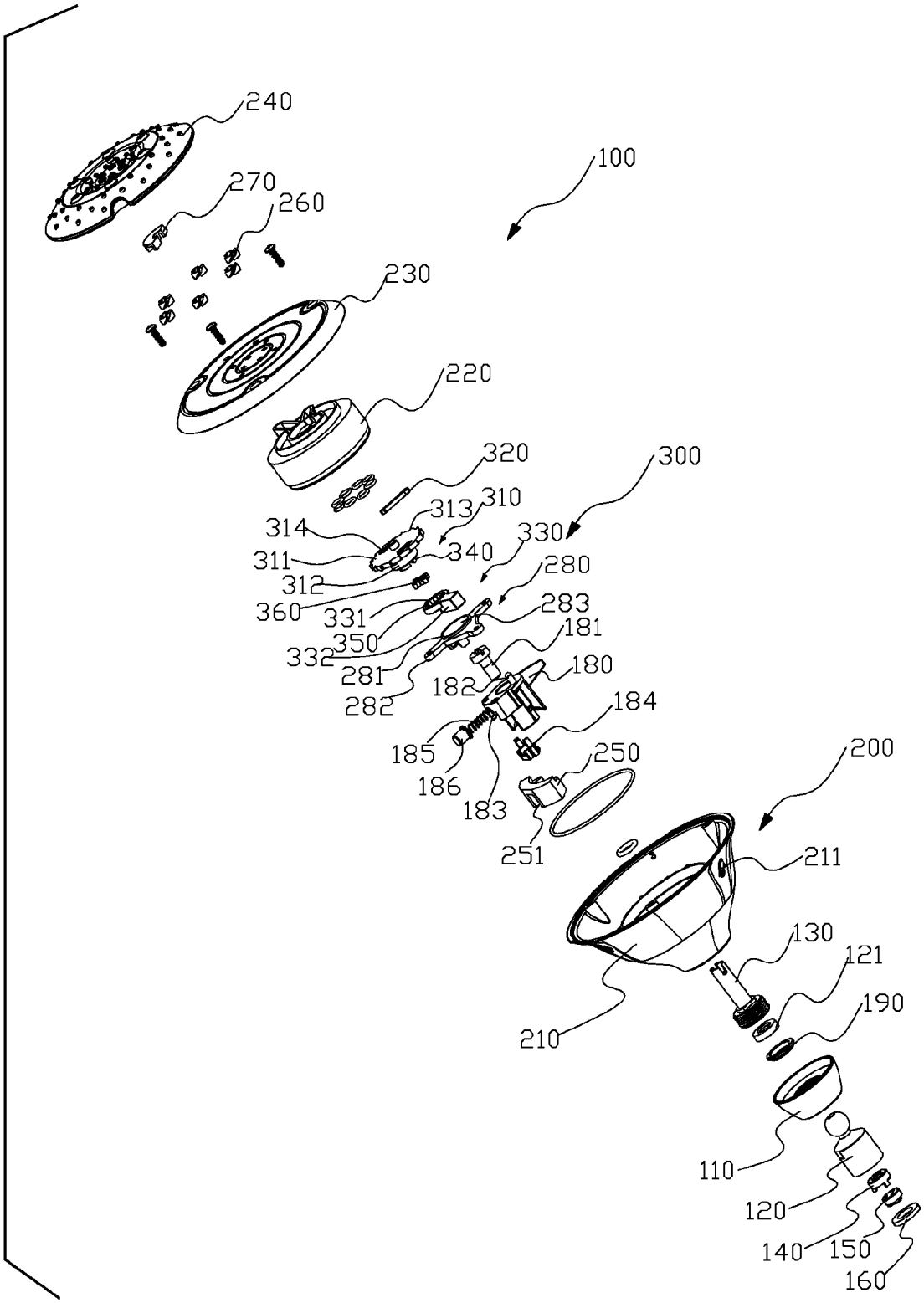
FIG. 2 shows the first solid exploded view of the single point touch shower in the present invention.
Figure 3:
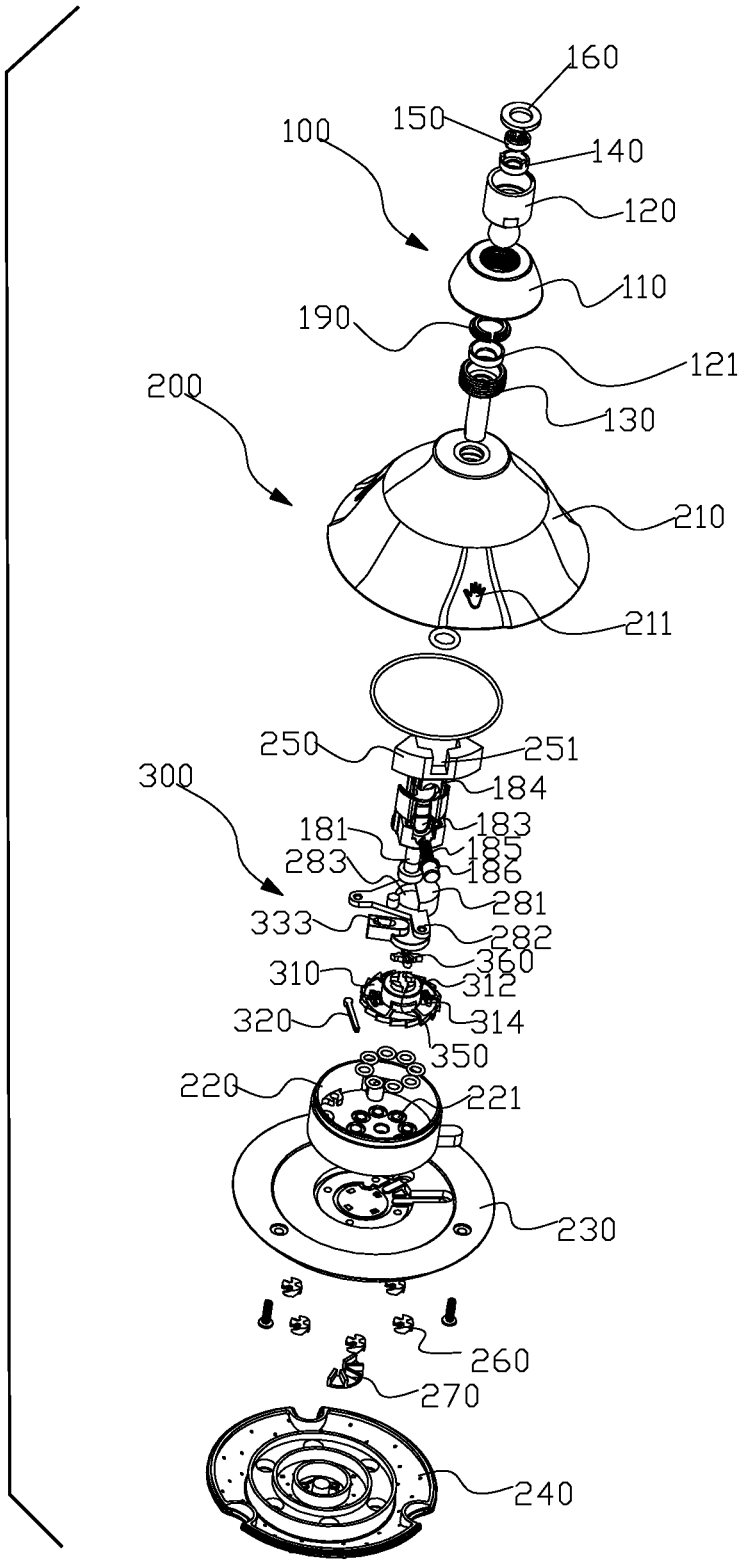
FIG. 3 shows the second solid exploded view of the single point touch shower in the present invention.
Figure 4:
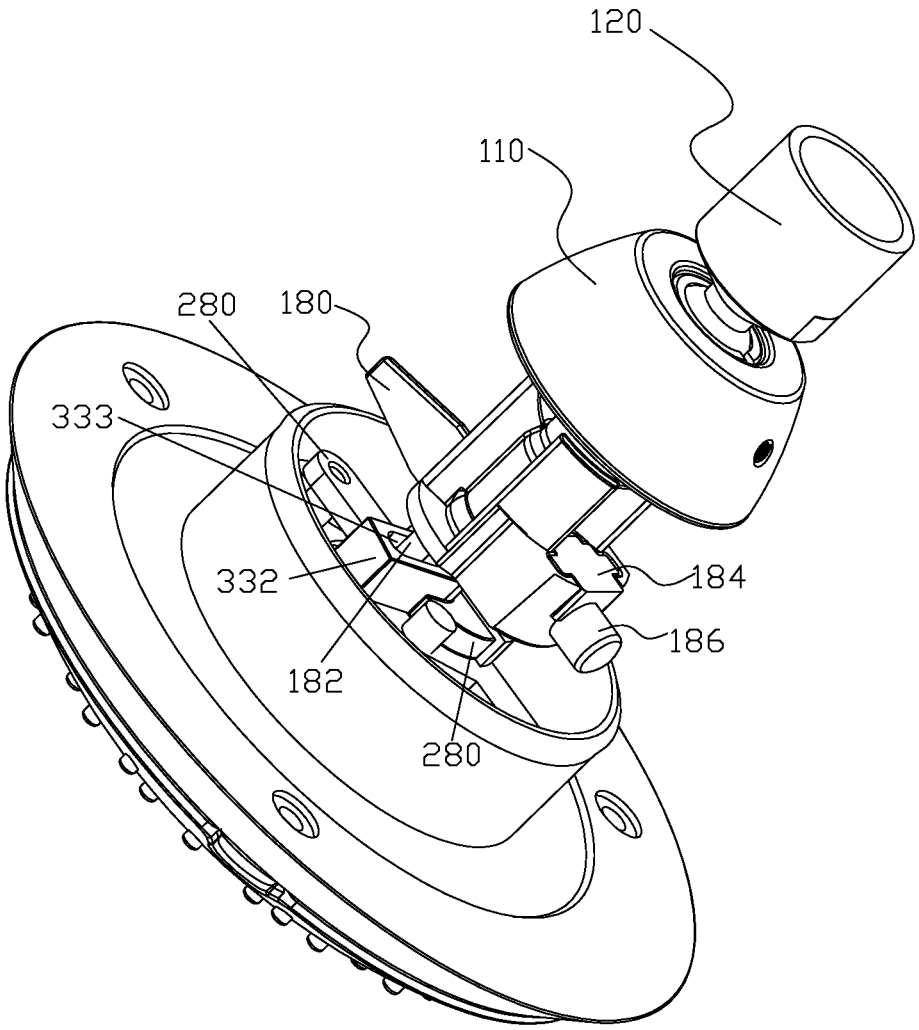
FIG. 4 shows the solid abridged general view of the single point touch shower in the present invention without the body.
Figure 5:
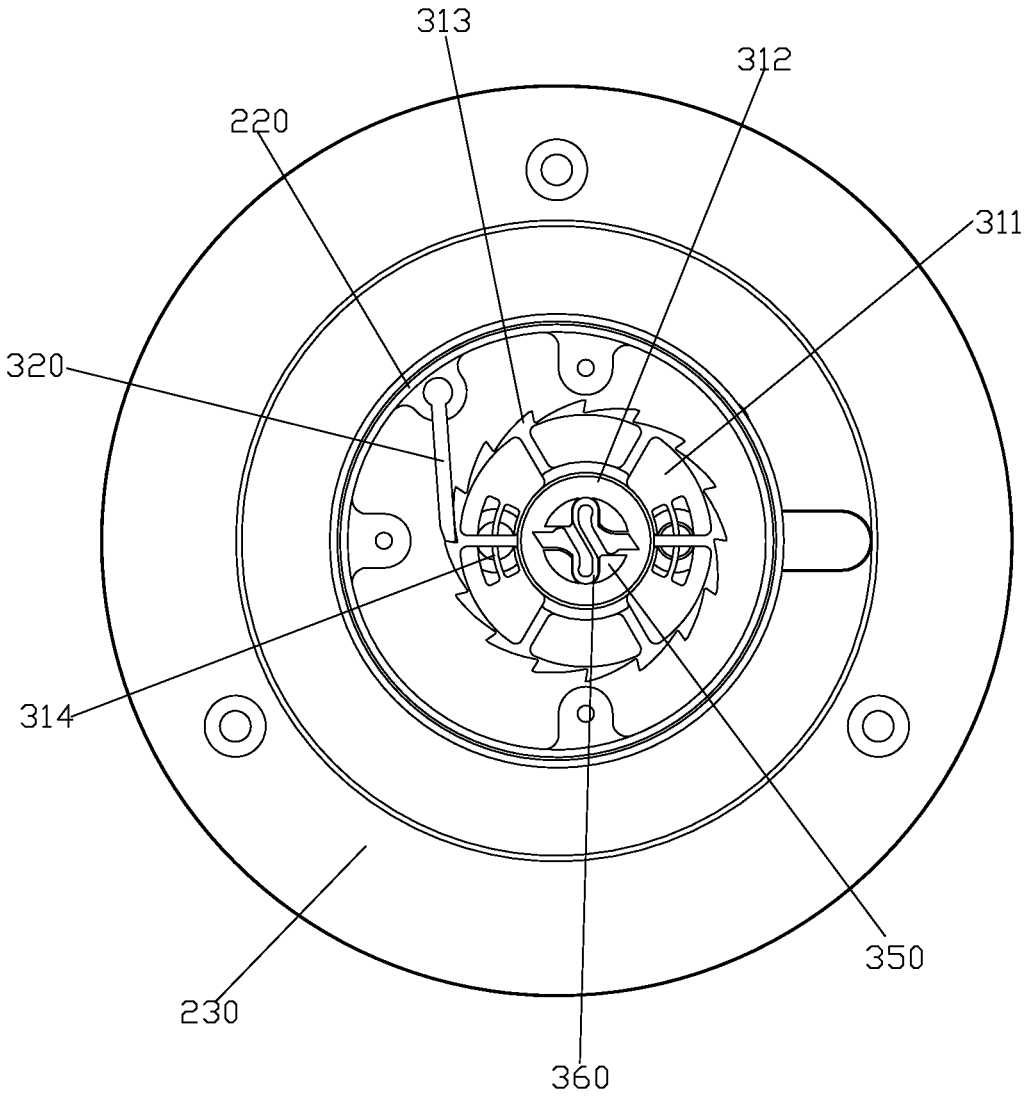
FIG. 5 shows the vertical abridged general view of the outlet terminal of the single point touch shower in the present invention.
Figure 6:
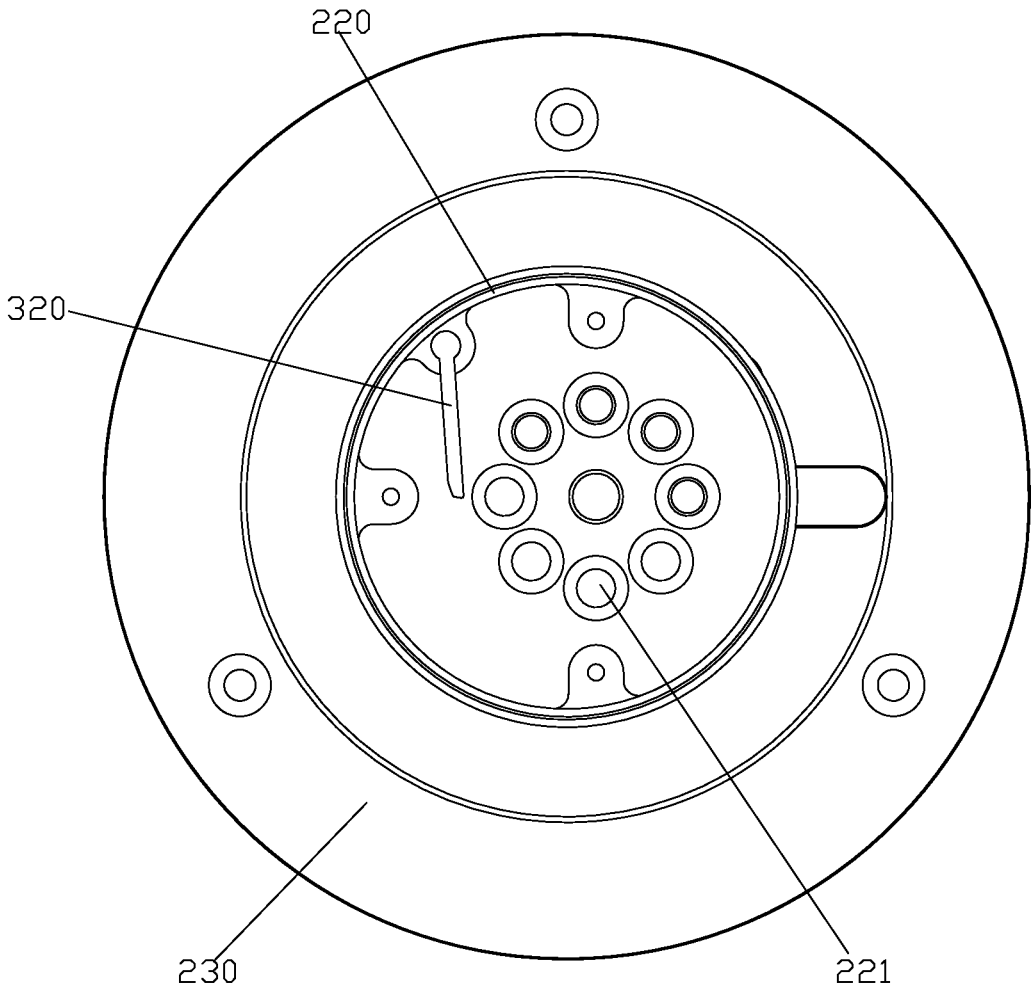
FIG. 6 shows the vertical abridged general view of the outlet terminal coupling with the first ratchet wheel, the clutch ratchet of the single point touch shower in the present invention.
Figure 7:
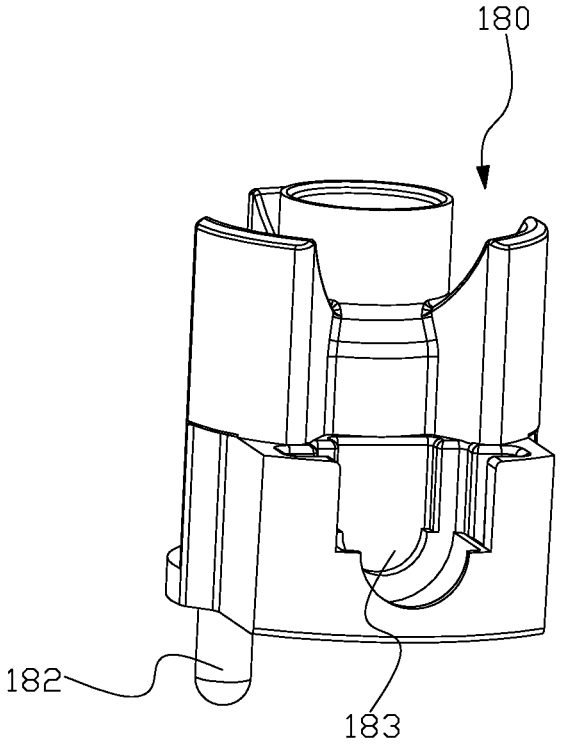
FIG. 7 shows the solid abridged general view of the spring seat of the single point touch shower in the present invention.
Figure 8:
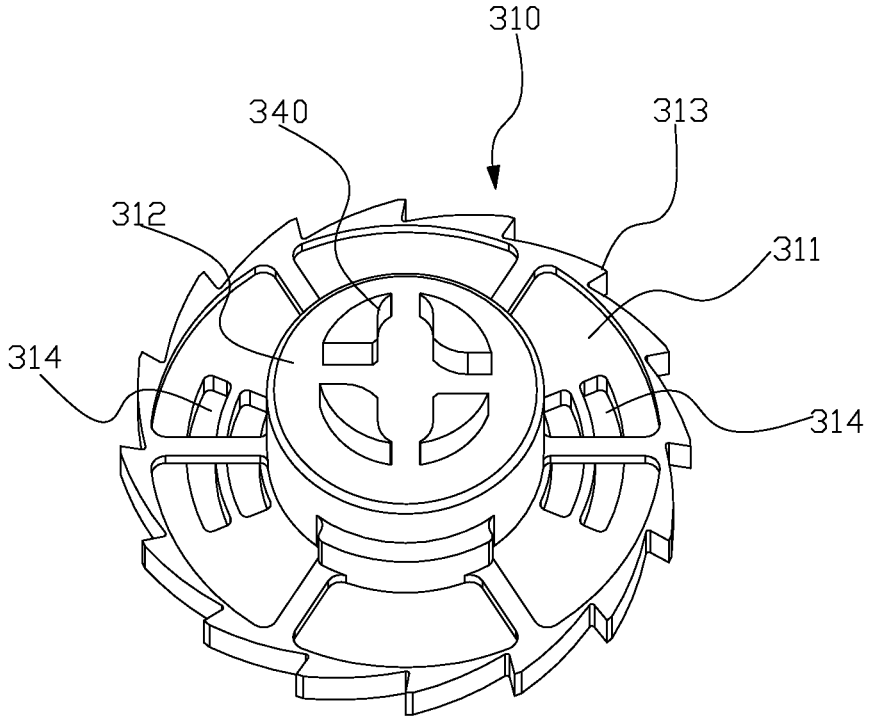
FIG. 8 shows the first solid abridged general view of the first ratchet wheel of the single point touch shower in the present invention.
Figure 9:
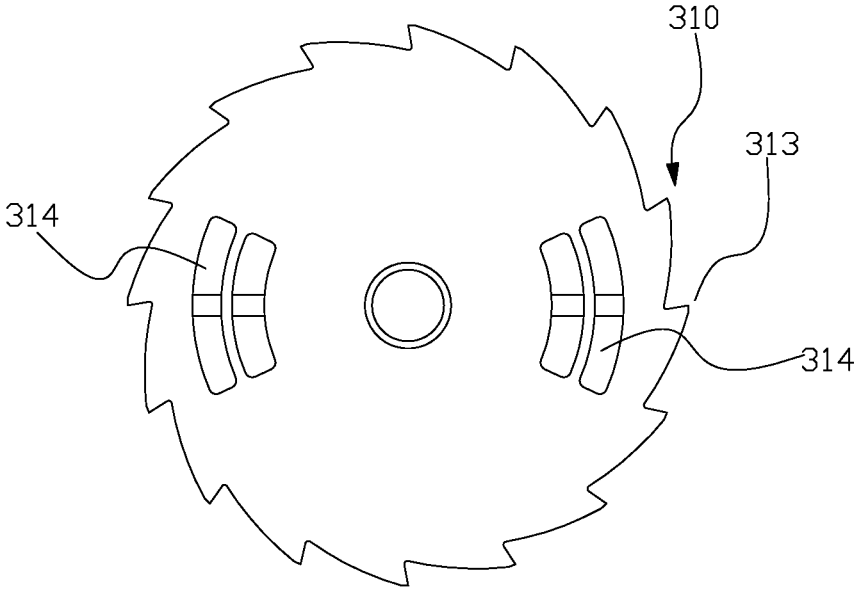
FIG. 9 shows the second solid abridged general view of the first ratchet wheel of the single point touch shower in the present invention.
Figure 10:
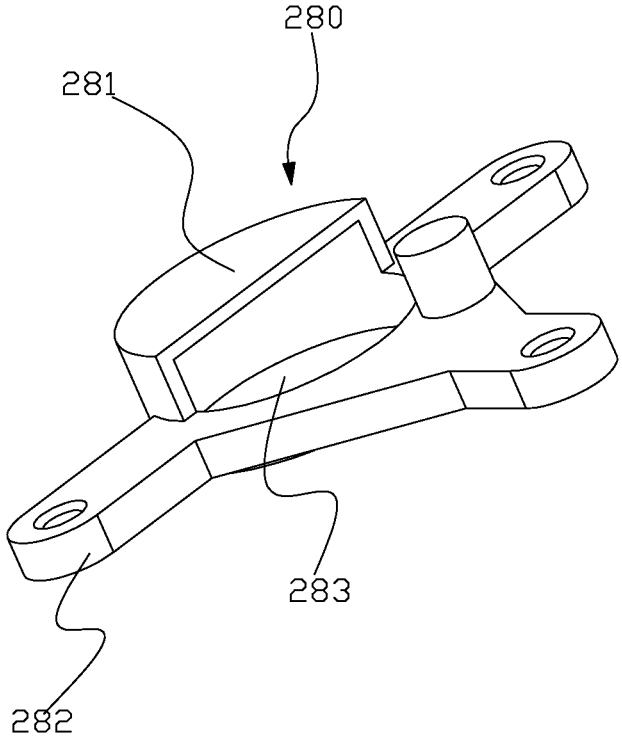
FIG. 10 shows the solid abridged general view of the support seat of the single point touch shower in the present invention.
Figure 11:
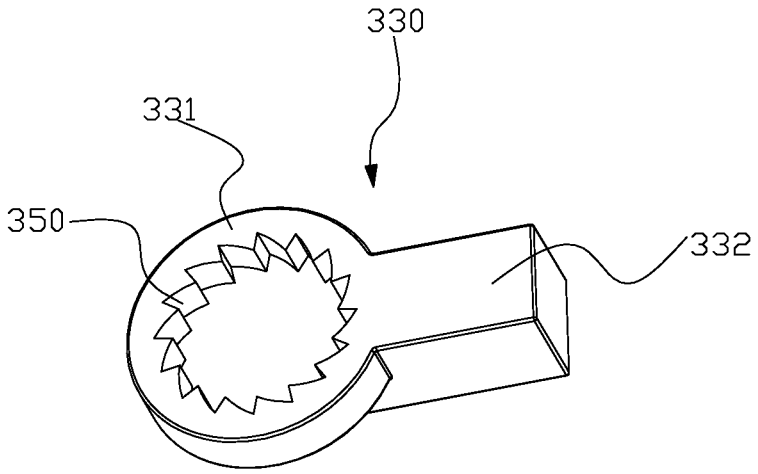
FIG. 11 shows the first solid abridged general view of the second ratchet wheel of the single point touch shower in the present invention.
Figure 12:
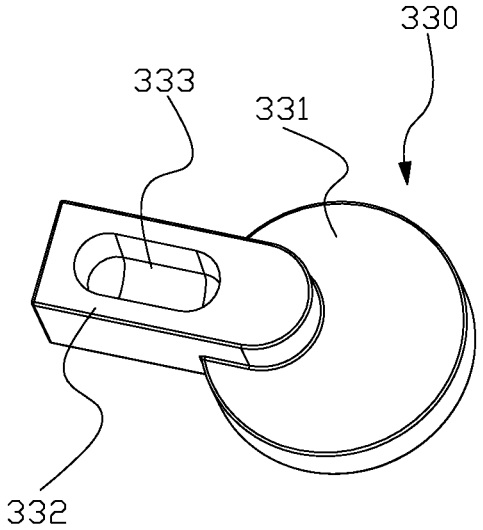
FIG. 12 shows the second solid abridged general view of the second ratchet wheel of the single point touch shower in the present invention.
Figure 13:
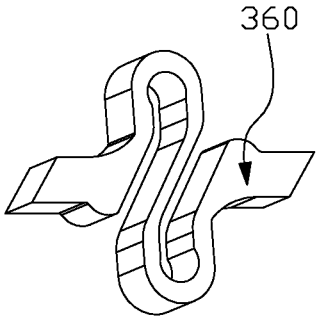
FIG. 13 shows the solid abridged general view of the clutch ratchet of the single point touch shower in the present invention.
Figure 14:
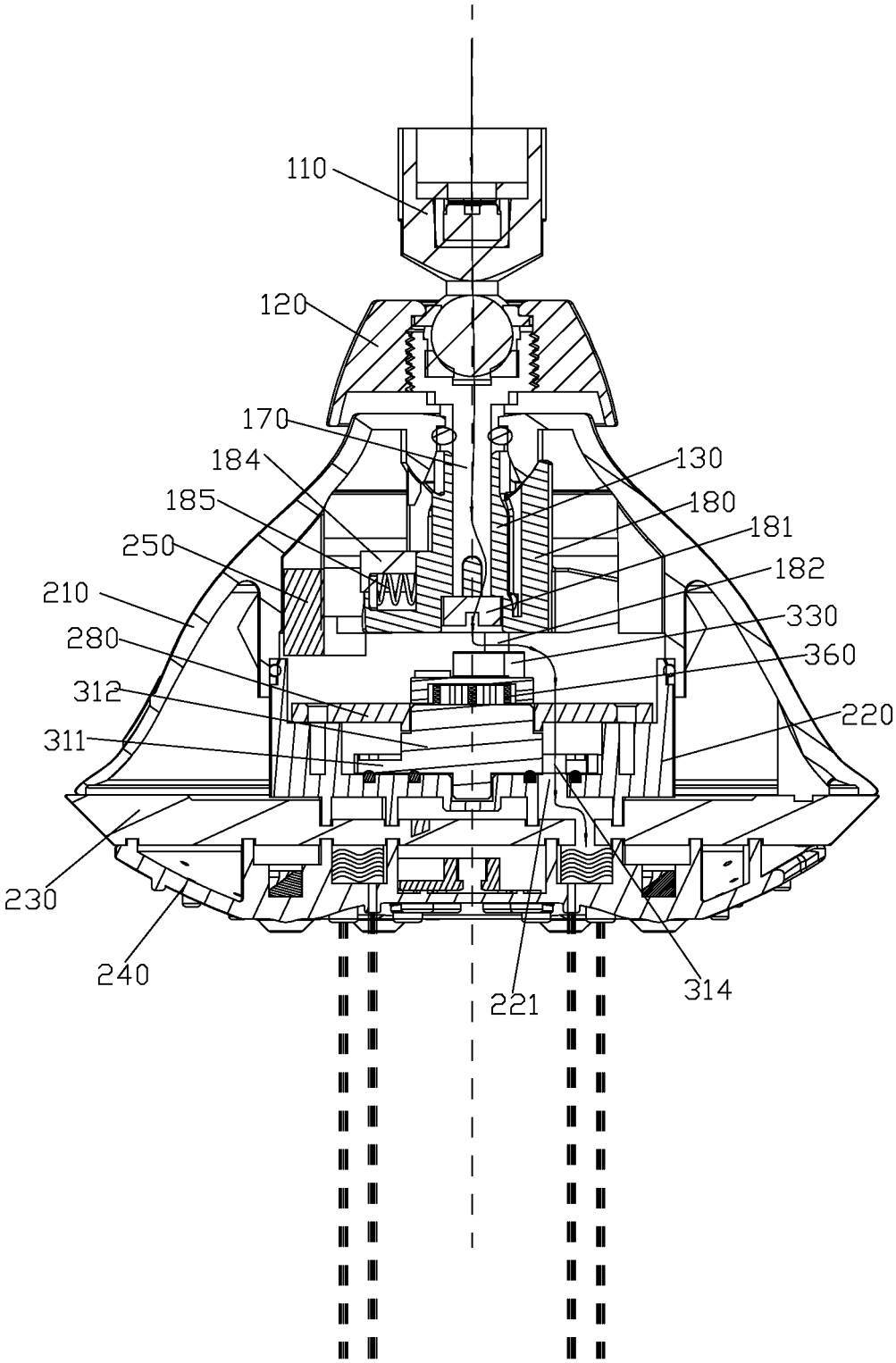
FIG. 14 shows the waterway abridged general view of the single point touch shower in the present invention, the inner ring shower water comes out of the shower at the moment.
Figure 15:
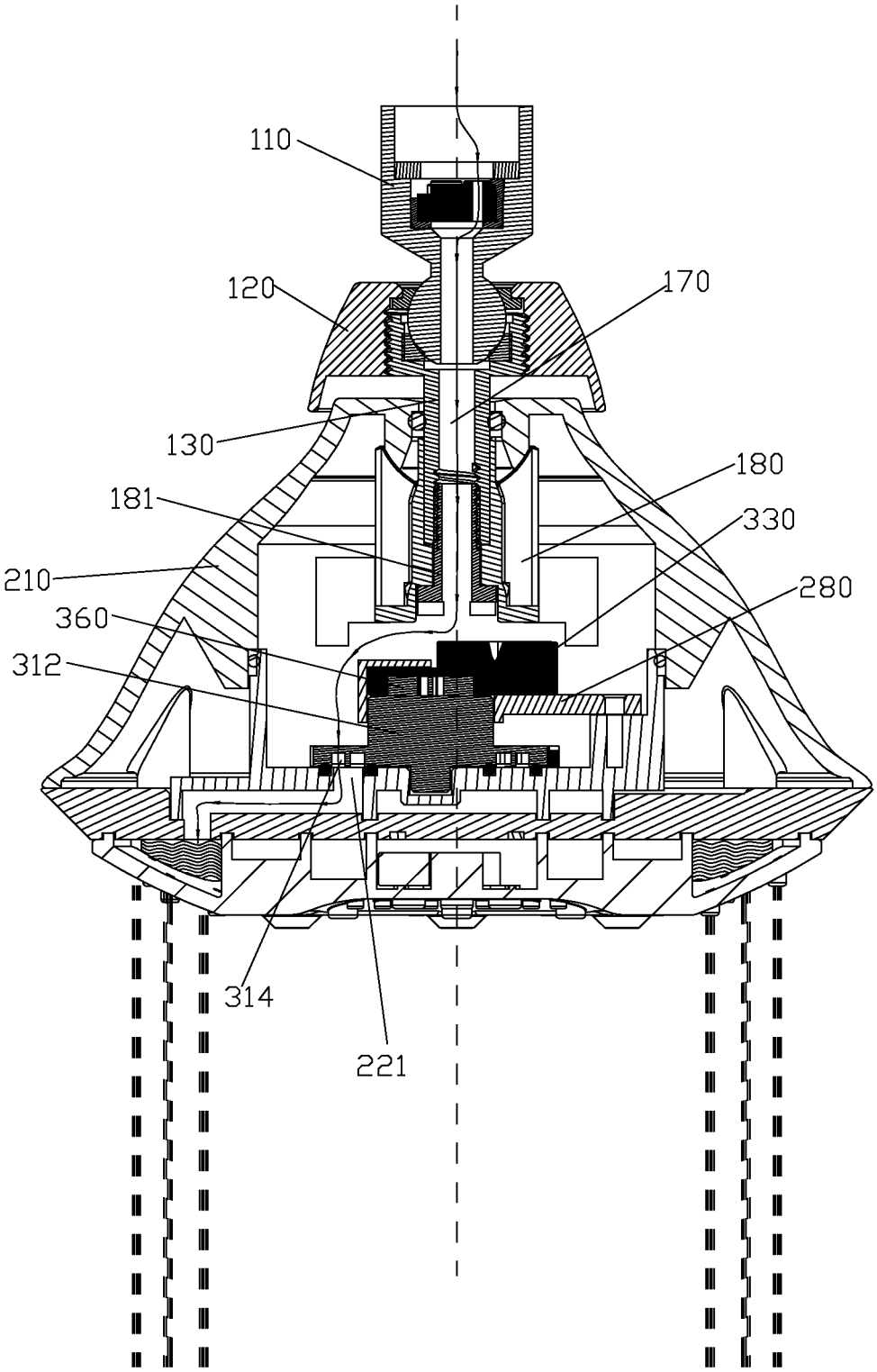
FIG. 15 shows the waterway abridged general view of the single point touch shower in the present invention, the outer ring shower water comes out of the shower at the moment.
Figure 16:
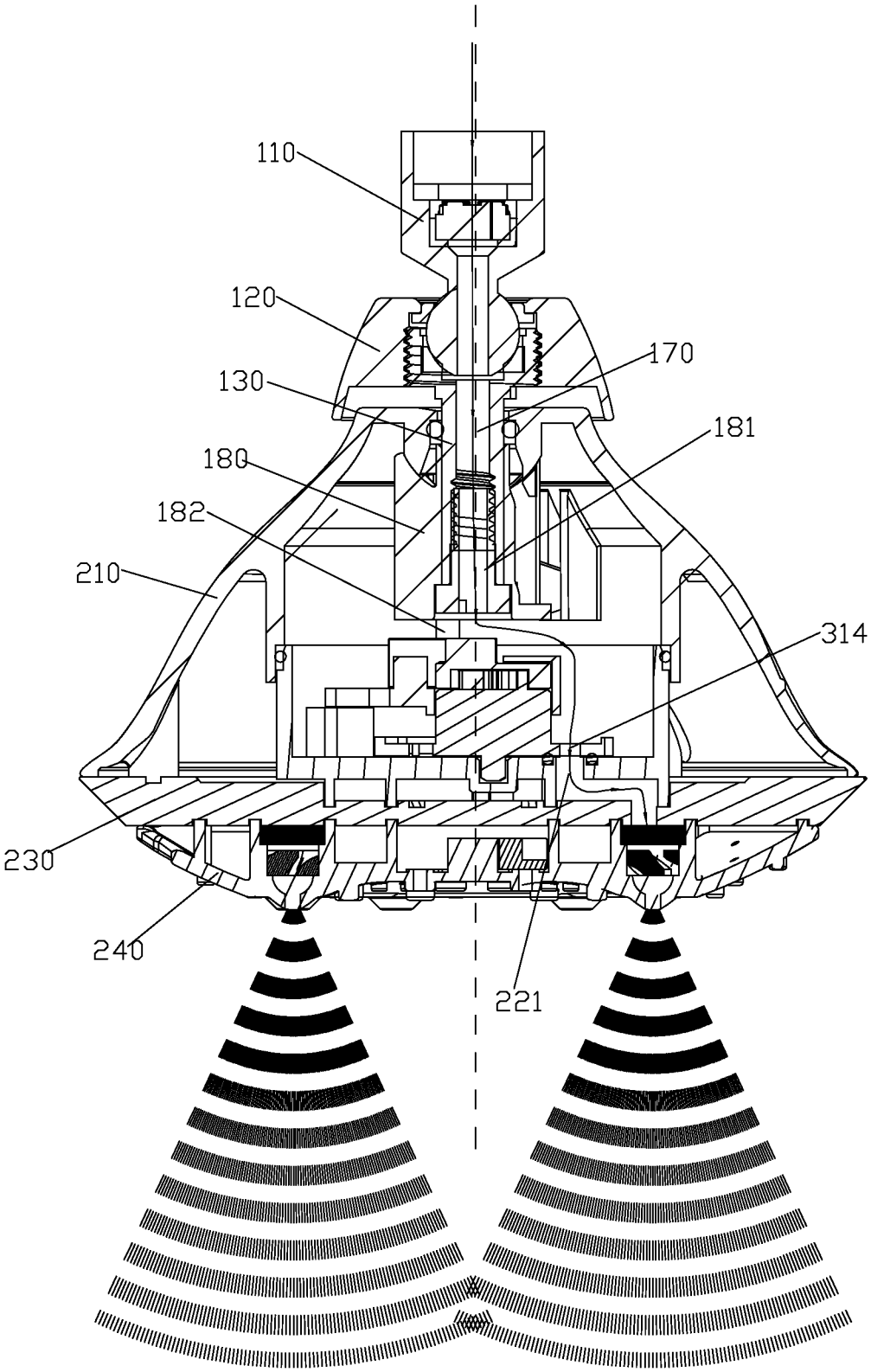
FIG. 16 shows the waterway abridged general view of the single point touch shower in the present invention, the atomizing water comes out of the shower at the moment.
Figure 17:
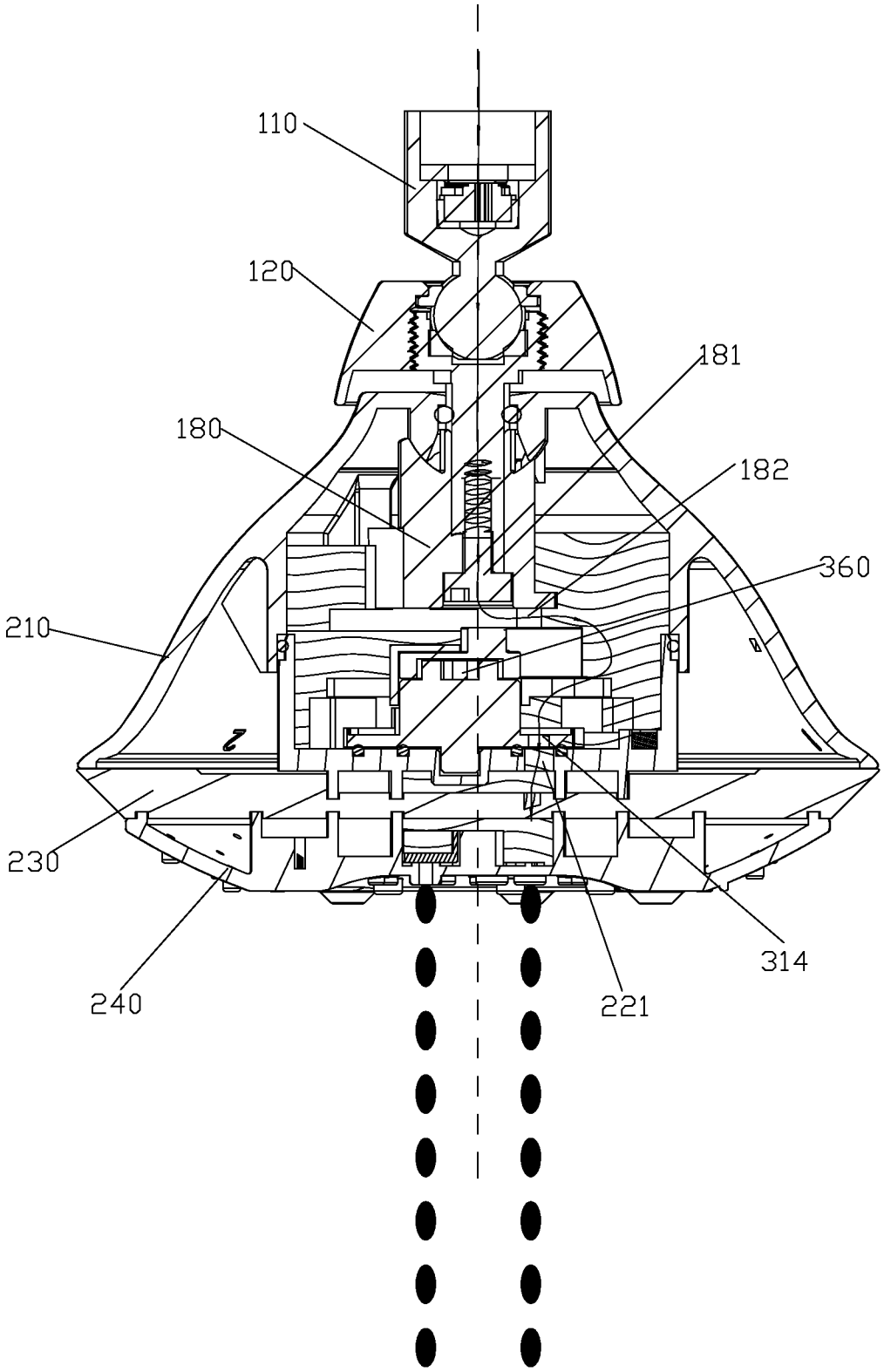
FIG. 17 shows the waterway abridged general view of the single point touch shower in the present invention, the massage water comes out of the shower at the moment.

With the following description of the drawings and specific embodiments, the invention shall be further described in details.

According to FIG. 1 to FIG. 23, the single point touch shower comprises a fixed unit 100, an outlet terminal 200 and a switching mechanism 300.

The fixed unit 100 comprises a ball joint support seat 110, a ball joint 120 and a inlet body 130. The ball joint 120 is fixedly connected in the ball joint support seat 110, and is fixedly connected to the water resource through the jacket 140, the water saving slice 150 and the gasket 160; the ball joint 120 is fixedly connected in the ball joint support seat 110 through the snap ring 190. The inlet body 130 is fixedly connected in the ball joint support 110, and the hollow hole of the inlet body 130 is communicated with the hollow hole of the ball joint 120, and a spherical gasket 121 is hermetically connected in the communication for the tightness of the communication. A spring seat 180 is fixedly sleeved out of the inlet body 130, and the spring seat 180 is lockingly connected to the inlet body 130 through the hollow screw 181. In the present embodiment, a inlet passage 170 is formed by the hollow hole of the ball joint 120, the hollow hole of the inlet body 130 and the hollow hole of the hollow screw 181. A eccentric contact 182 is convexly extended below the spring seat 180.

An assembly slot 183 is opened and formed on the outboard surface of the spring seat 180, and a shackle pin 184 is connected on the spring seat 180. The shackle pin comprises a coupling seat coupling with the assembly slot 183 and two impending ends that are fixedly connected below the coupling seat, and a clamping seat is arranged at the end of the impending end, the clamping seat of the impending end is connected to the spring seat 180 and makes the coupling seat and the shackle pin 184 correspond to each other. A return spring 185 is mounted in the assembly slot 183, and a spring cap 186 with small head and big tail is connected to the end of the return spring 185, the tail of the spring cap 186 is connected to the end of the return spring 185, and the head of the spring cap is extends out of the abdicating hole formed by the coupling seat of the assembly 183 and the shackle pin 184 and is against the back of the coupling seat.

The outlet terminal 200 comprises a body 210, a water diversion body 220, a water diversion disc 230, a face cover 240 and a transmission bearing 280.

The body 210 is hermetically sleeved out of the inlet body 130 and supports the spring seat 180, so that the body 210 can swing relative to the spring seat 180, and then the outlet terminal 200 can swing relative to the spring seat 180, and then the outlet terminal 200 can swing relative to the fixed unit 100, the following proposal can be used for achieving the aim above: a guide seat 250 is arranged in the outlet terminal 200, and a guide slot 251 is arranged in the guide seat 250, and a guide part is arranged on the fixed unit 100, the guide part can slidingly connected to the guide slot to achieve the limit along the swing direction. In the present embodiment, the guide part is the spring cap 186, and the guide seat 250 is fixed on the internal rotative surface of the body 210. The end of the spring cap 186 of the spring seat 180 is against the internal rotative surface of the body 210.

The water diversion body 220 comprises a footwall and a surrounding wall that is extended upward from the periphery of the foot wall, and four groups of water diversion holes 221 is opened on the footwall, and every group comprises two water diversion holes 221. In the present embodiment, the amount of the water diversion hole group is equal to the amount of the outlet functions, but is not limited to four groups, other amount (such as three or five) is also fit to the present embodiment, namely the amount of the outlet functions is not limited to four, other amount (such as three or five) is also fit to the present embodiment; and the amount of the water diversion holes 221 is each group is not limited to two, other amount (such as one) is also fit to the present embodiment. The footwall of the water diversion body 220 is fixedly connected to the water diversion disc 230. The water diversion disc 230 is hermetically and fixedly connected under the body 210 through the bolt. A user touching mark 211 is better to be arranged out of the water diversion body 220 for the accurate touching of users.

The face cover 240 is hermetically and fixedly connected under the water diversion disc 230, and the face cover 240 is coupling with the water diversion disc 230 to form four independent outlet cavities, the corresponding mechanisms are opened on the part of the face cover 240 corresponding to the four independent outlet cavities for the four kinds of sprays (outlet functions) from the four independent outlet cavities. In the present embodiment, the four kinds of sprays are the outer ring is shower water, the inner ring shower water, the atomizing water and the massage water, and correspondingly, a fog implement is arranged in one of the independent cavities, an impeller 270 is arranged in one of the independent cavities. The four groups of the water diversion holes 221 are correspondingly communicated with the four independent outlet cavities.

The transmission bearing 280 comprises bearing body 280 and a plurality of connecting rod 280 being fixedly connected to the bearing body 281; a pivot joint hole 283 is opened on the bearing body 281; the end of the connecting rod 282 is fixedly connected to the water diversion body 220, and because of the big clearance between the adjacent connecting rod 282, the water diversion body 220 will not be sealed. And the inlet cavity communicating with the inlet passage 170 is formed between the whole body 210 and the water diversion disc 230, and the inlet cavity also comprises the part in the surrounding wall of the water diversion body 220.

The switching mechanism 300 comprises a first ratchet wheel 310, a stopping claw 320 and a transmission mechanism.

The first ratchet wheel comprises a base plate 311 and a convex shaft 312 being fixedly connected on the base plate 311, the external ratchets 313 are arranged at the outside of the base plate 311, and a group of outlet openings 314 that are out of the convex shaft 312 are opened on is the base plate 311, the outlet openings 314 are corresponding to the water diversion holes 221. The first ratchet wheel 310 is hermetically and pivotally arranged in the water diversion body 220, and the bottom surface of the first ratchet wheel 310 is hermetically and rotationally connected to the footwall of the water diversion body 220, so that the outlet openings 314 can be corresponding to the water diversion hole 221, and the outlet openings 314 can be alternatively aligned to and communicated with one of the water diversion hole 221 through the rotation of the first ratchet wheel 310, the communication between the outlet openings and the inlet cavity and one of the outlet functions is controlled by the relative rotation between the first ratchet wheel and the water diversion body, and then the switching of the outlet functions is controlled. The convex shaft 312 of the first ratchet wheel 310 can rotationally connected to the lower part of the pivot joint hole 283 of the bearing body 281 of the transmission bearing 281, and the base plate 311 id under the bearing body 281.

One end of the stopping claw 320 is connected to the internal rotative surface of the surrounding wall of the water diversion body 220, and another end is connected to the external ratchets of the first ratchet wheel 310 for the limit of the reversal of the first ratchet wheel 310.

The first ratchet wheel 310 and the fixed unit 100 are connected through the transmission mechanism to transmit the mutual swing is between the outlet terminal 200 and the fixed unit 100 to the relative rotation between the first ratchet wheel 310 and the water diversion body 220. The transmission mechanism comprises a actuator 330 and a clutch mechanism, the actuator 330 comprises a second ratchet wheel 331 and an extended part 332 being fixedly connected to the second ratchet wheel 331, the second ratchet wheel 331 can rotationally connected to the upper part of the pivot joint hole 283 of the bearing body 281, and the extended part 332 extends out of the bearing body 282, and a right or left-hand connecting slot 333 id opened above the extended part 332, the lower end of the contact 182 of the spring seat 180 is adaptively connected in the connecting slot 333, so that the contact 182 can touch and make the extended part 332 rotate when the extended part 332 swing relative to the spring seat 180, and the positive rotation and the reversal of the actuator 330 can be driven. The clutch mechanism is connected to the actuator and the first ratchet wheel, so that the positive rotation of the first ratchet wheel 310 is driven when the actuator rotates positively, and the first ratchet wheel stops when the actuator 330 reverse. In the present embodiment, the clutch mechanism comprises a first inner ratchet 340 convexly arranged at the end face of the convex shaft of the first ratchet wheel 310, a second inner ratchet 350 opened in the inner hole of the second ratchet wheel 331 and a clutch ratchet 360, the upper part of the clutch ratchet 360 is connected to the second inner ratchet 350 of the second ratchet wheel 331, and its lower part is connected to the first inner ratchet 340 of the first ratchet wheel 310.

Figure 18:
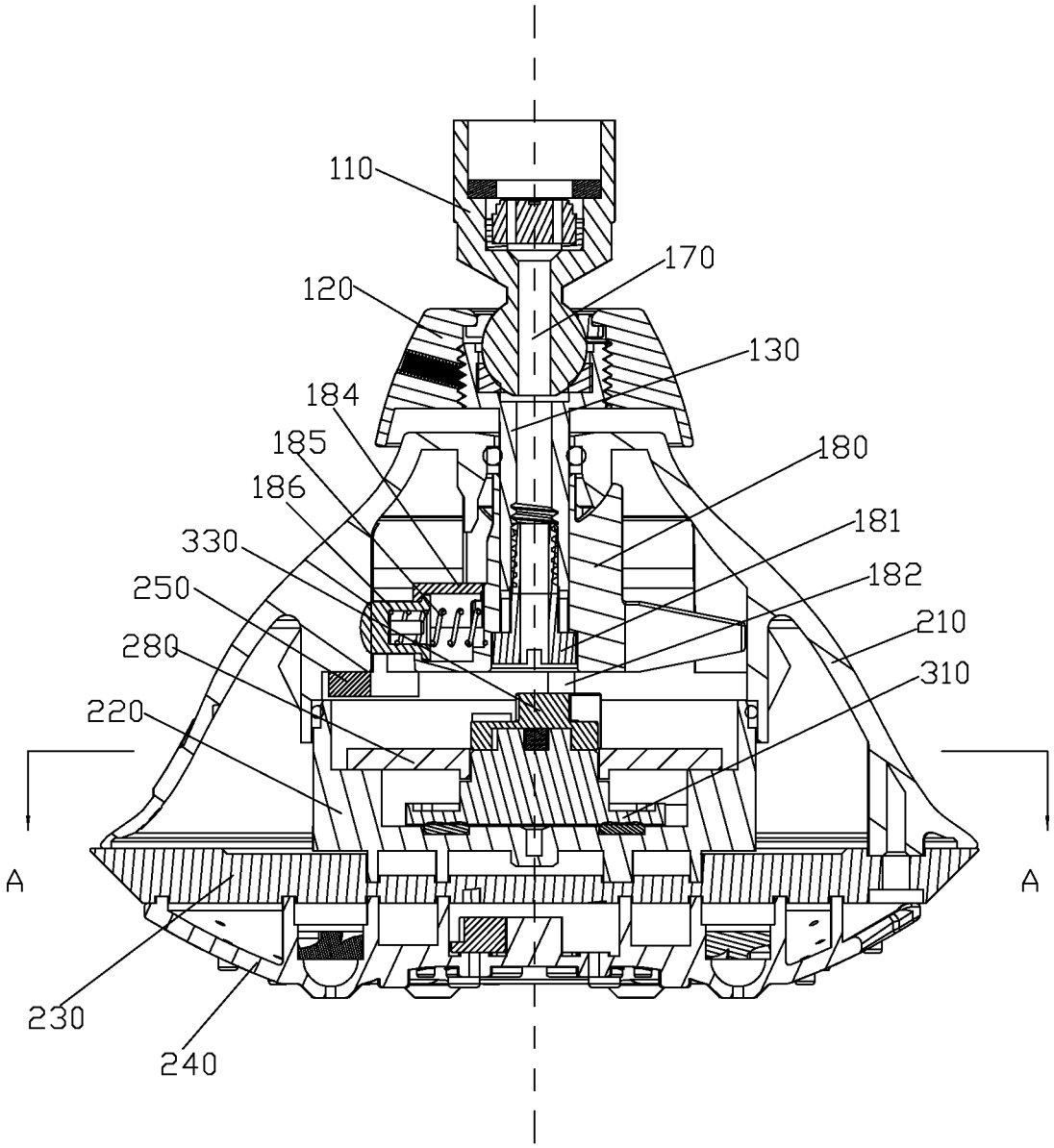
FIG. 18 shows the cross-sectional view of the single point touch shower in the present invention, the shower is at the original position at the moment, and the first outlet function is active.
Figure 19:
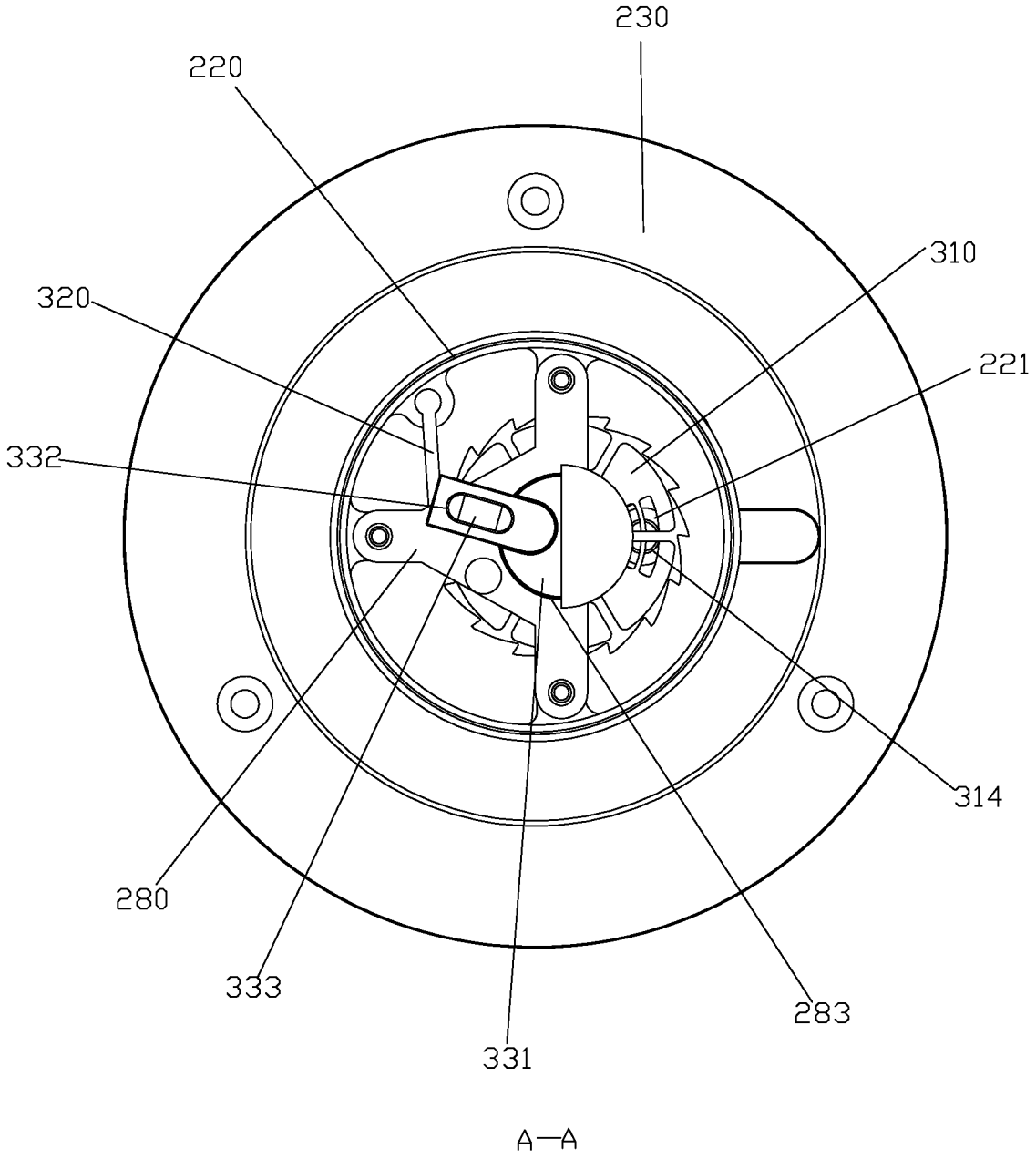
FIG. 19 shows the structure abridged general view of the single point touch shower in the present invention, the shower is at the original position at the moment, and the first outlet function is active.

Combining with the switching principle in the present invention, the switching process in the present invention is described in detail below:

According to FIGS. 18 and 19, water comes out of the first outlet function at the moment, the shower is at the original position, and the outlet opening 314 of the first ratchet wheel is corresponding to the first water diversion hole 221;

The users touch the mark 211 of the body 220 or its surrounding place with single point, and then the outlet terminal 220 swing to left relative to the fixed unit 100;

The actuator 330 in the outlet terminal 200 swings to left relative to the spring seat 180, and the actuator 330 rotates positively with the coupling of the contact 182 and the connecting slot 233, compressing the return spring 185 for energy storing.

The first ratchet wheel 310 is driven to rotate positively by the actuator 330 through the closed clutch mechanism, namely through the first inner ratchet, the second inner ratchet and the transmitting ratchet, and the outlet opening 314 starts to be staggered from the first water diversion hole 221.

Figure 20:
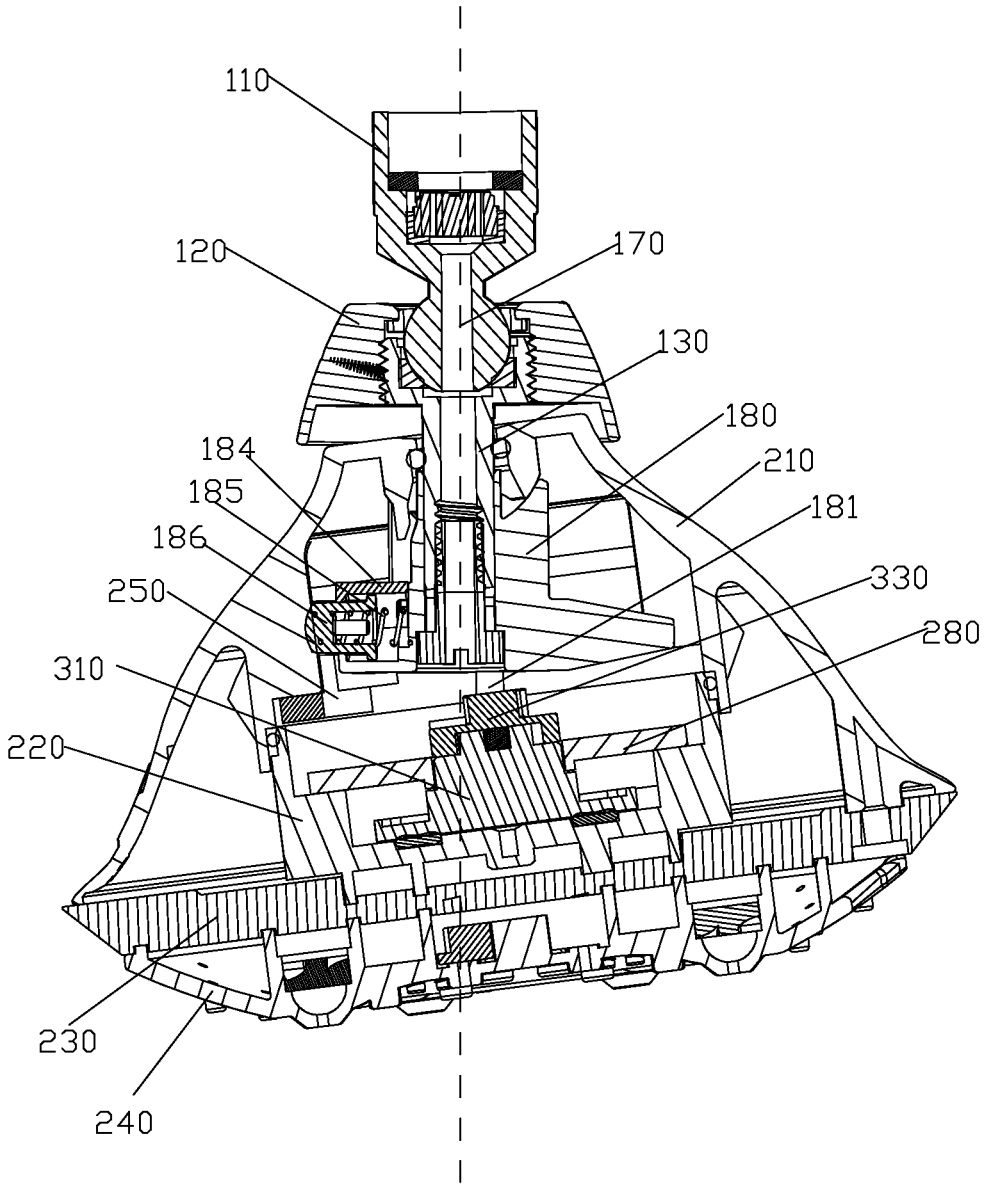
FIG. 20 shows the cross-sectional view of the single point touch shower in the present invention, the shower is at the swing position at the moment.
Figure 21:
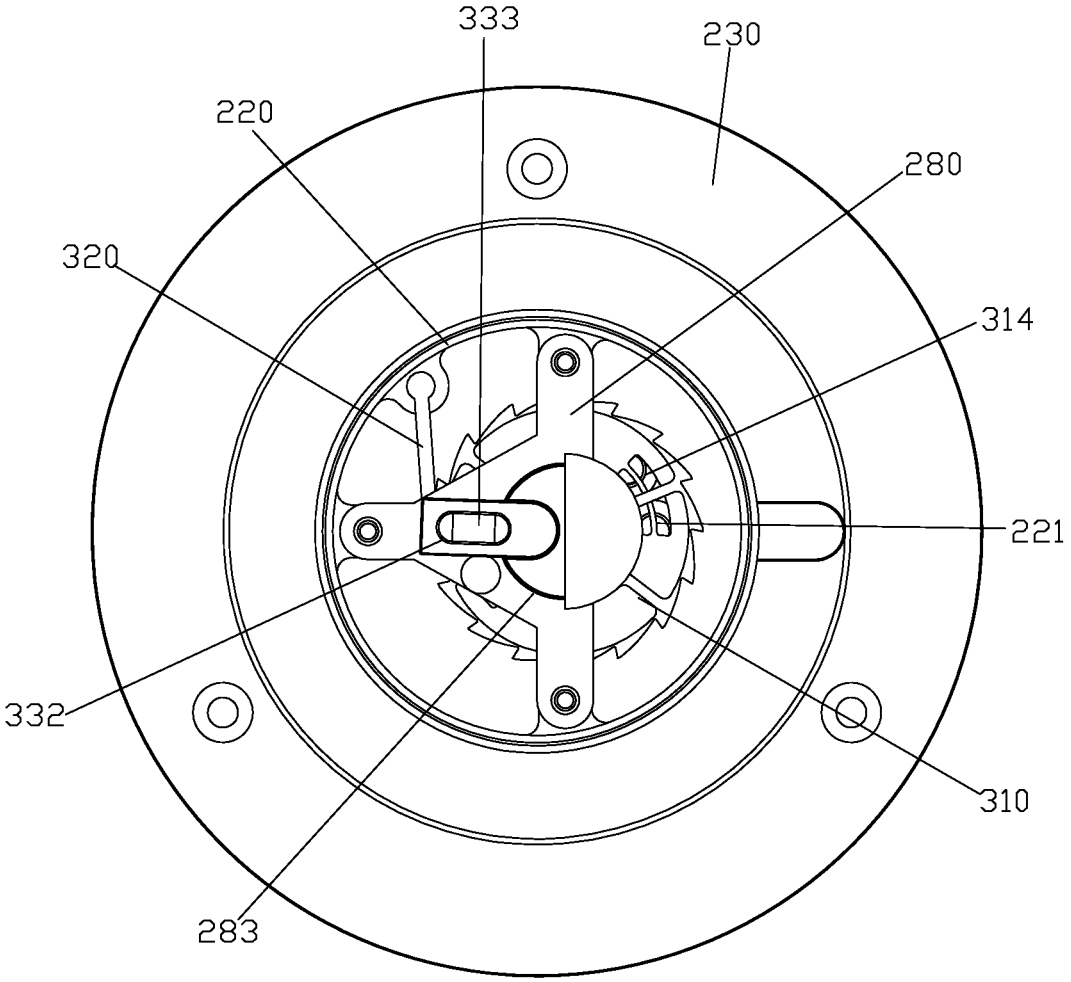
FIG. 21 shows the structure abridged general view of the single point touch shower in the present invention, the shower is at the swing position at the moment.
Figure 22:
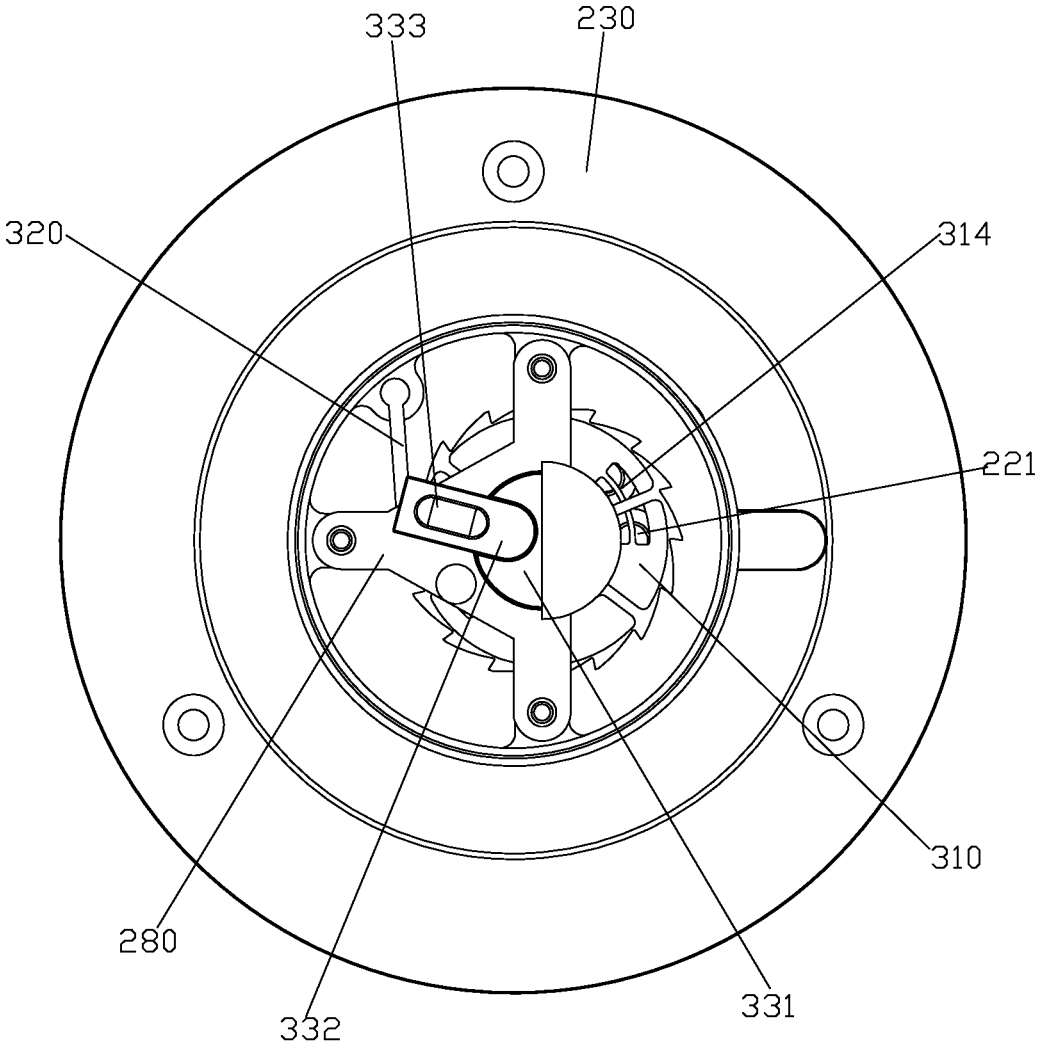
FIG. 22 shows the first structure abridged general view of the single point touch shower in the present invention, the shower is at the resetting position at the moment, and the second outlet function is active.
Figure 23:
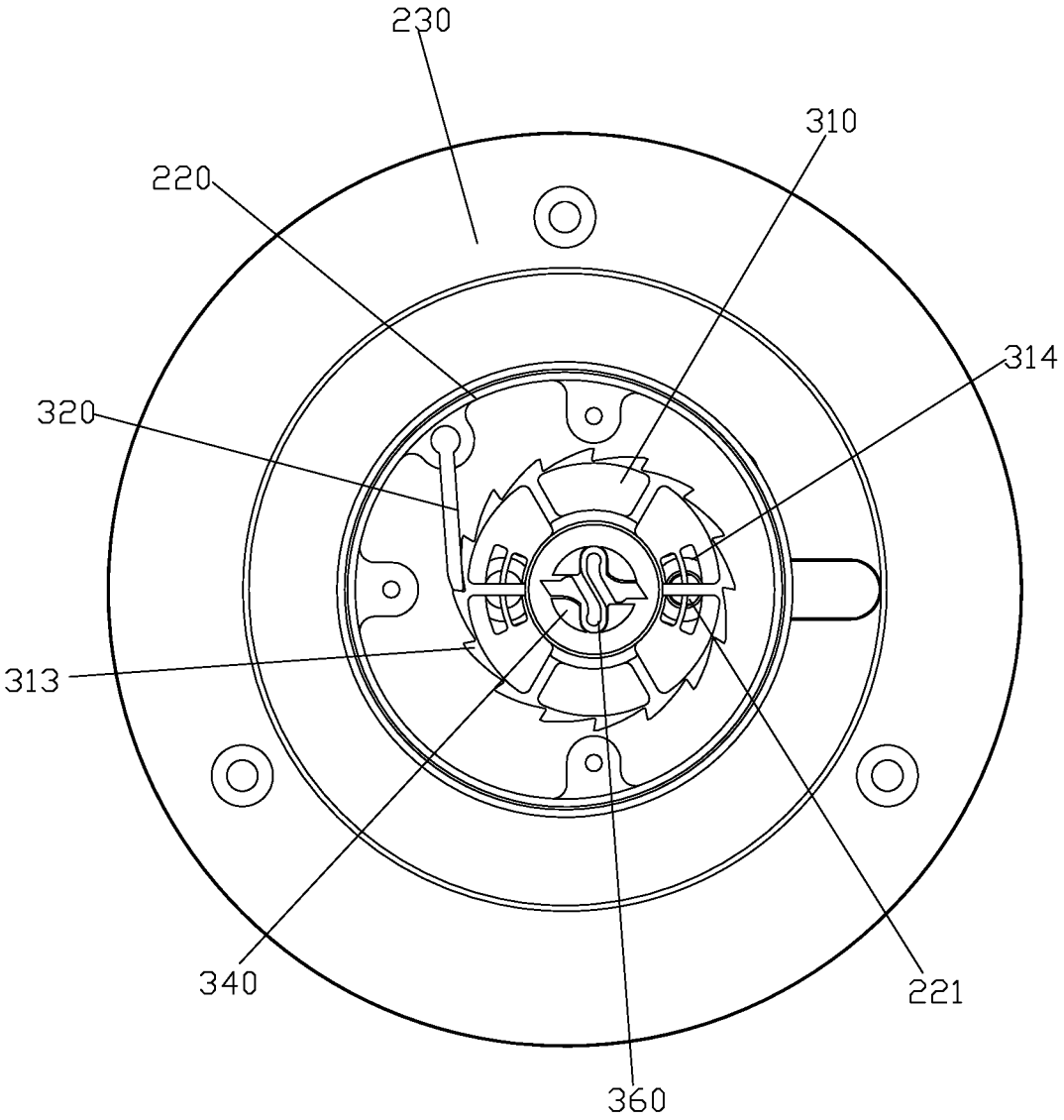
FIG. 23 shows the second structure abridged general view of the single point touch shower in the present invention, the shower is at the resetting position at the moment, and the second outlet function is active.

According to FIGS. 20 and 21, when the outlet terminal 200 swings to is left position relative to the fixed unit 100, the outlet opening 314 is aligned to the second water diversion hole 221, and water comes out of the second outlet functions, and the shower is at the swing position; the stopping claw 320 is against the outer ratchet of the first ratchet wheel 310 just in time to prevent the first ratchet wheel 310 reversing at the moment, so that it can maintain the water coming out of the second outlet function;

The user looses, and the energy in the return spring 185 is released, and the outlet terminal 220 is driven to swing to right relative to the fixed unit 100;

The actuator 330 in the outlet terminal 200 swings to right relative to the spring seat 180, and the actuator 330 reverses with the coupling of the contact 182 and the connecting slot 233;

The clutch mechanism is at the detached state at the moment, namely the second inner ratchet and the transmitting ratchet resets along with the reversal of the actuator 330, and the first inner ratchet stops, and the first ratchet wheel stops;

According to FIGS. 22 and 23, when the outlet terminal 200 swings to right position relative to the fixed unit 100, the shower returns to the original position, the outlet opening 314 is switched from the first water diversion hole 221 to the second water diversion hole 221, and the outlet function is switched from the first to the second, and the switching is process is completed once.

The invention has been described with reference to the preferred embodiments mentioned above; therefore it cannot limit the reference implementation of the invention. It is obvious to a person skilled in the art that structural modification and changes can be carried out without leaving the scope of the claims hereinafter and the description above.

INDUSTRIAL APPLICABILITY

The single point touch shower in the present invention introduces the ratchet wheel to the switching mechanism of the swing switch shower, and the switching of different outlet functions is achieved by the one-way rotation of the ratchet wheel, so that the single point touch switching and rotary switching are achieved with simple switching mechanism, small space occupation and good industrial applicability.

What is claimed is:

1. A single point touch shower, comprising:

a fixed unit having an inlet passage connecting with a water resource;

an outlet terminal connected to the fixed unit so as to be movable relative to the fixed unit, the outlet terminal being provided with a plurality of outlet functions, the outlet terminal being responsive to a user's touch by being swingable relative to the fixed unit; and a switching mechanism including a first ratchet wheel connected to the outlet terminal so as to be able to rotate, a stopping claw connecting to the first ratchet wheel and the fixed unit to limit a reverse rotation of the first ratchet wheel, and a transmission mechanism including an actuator and a clutch mechanism connecting the actuator and the first ratchet wheel, the actuator being connected with the fixed unit so as to rotate relative to the fixed unit when the user touches the outlet terminal to cause the outlet terminal to swing relative to the fixed unit thereby causing the actuator to swing relative to the fixed unit, the transmission mechanism connecting the first ratchet wheel and the actuator to transmit the swing between the outlet terminal and the fixed unit, which causes the actuator to swing relative to the fixed unit and rotate relative to the fixed unit, to cause relative rotation between the first ratchet wheel and the outlet terminal through the rotation of the actuator relative to the fixed unit, and switching of outlet functions is controlled through the relative rotation between the first ratchet wheel and the outlet terminal.

2. The single point touch shower according to claim 1, wherein outlet openings are within and open up on the first ratchet wheel, and the rotation between the first ratchet wheel and the outlet terminal controls communication between the outlet openings and an outlet passage to control one of the outlet functions.

3. The single point touch shower according to claim 2, further comprising a return spring arranged between the fixed unit and the outlet terminal to reset the swing of the outlet terminal.

4. The single point touch shower according to claim 3, wherein the fixed unit includes a contact fixed in the fixed unit;

the actuator having an aperture that the contact is inserted into so that the actuator slides along the contact to be driven in positive rotation and reversal rotation of the actuator when the outlet terminal swings relative to the fixed unit, the clutch mechanism connecting the actuator and the first ratchet wheel so that the first ratchet wheel can rotate positively when the actuator rotates positively, or so that a portion of the clutch mechanism connected with the first ratchet wheel does not rotate with the actuator in the reversal rotation thereof so that the stopping claw stops the first ratchet wheel from rotating in a reverse direction when the actuator is rotating in the reverse direction.

5. The single point touch shower according to claim 4, wherein, the actuator comprises a second ratchet wheel and an extended part fixedly connected to the second ratchet wheel, the extended part being coupled with the contact, and the clutch mechanism being connected between the second ratchet wheel and the first ratchet wheel.

6. The single point touch shower according to claim 5 wherein, the clutch mechanism comprises:

a first inner ratchet opened in the first ratchet wheel;

a second inner ratchet opened in the second ratchet wheel; and a clutch ratchet connecting the first inner ratchet and the second inner ratchet, wherein the first ratchet wheel is provided with an outer ratchet coupling with the stopping claw.

7. The single point touch shower according to claim 6, wherein, the fixed unit comprises:

an inlet body; and a spring seat fixedly connected to and projecting out of the inlet body, a hollow hole being formed in the inlet body;

the outlet terminal comprises:

a body; and an outlet mechanism, the body being hermetically sleeved out of the inlet body and supported above the spring seat, the outlet mechanism being fixedly connected under the body, the spring being mounted on the spring seat and against the body.

8. The single point touch shower according to claim 7, wherein the outlet terminal further comprises a support seat which is fixedly arranged on the outlet mechanism;

the first ratchet wheel comprises a base plate and a convex shaft fixedly arranged on the base plate, the outer ratchet is arranged on an outer rotative surface of the base plate, the first inner ratchet is arranged on an end face of the convex shaft, the base plate is located between the support seat and the outlet mechanism, the convex shaft being pivotally connected to the support seat.

9. The single point touch shower according to claim 8, wherein the second ratchet wheel is pivotally connected to the support seat, an upper part of the clutch ratchet is connected to the second inner ratchet, a lower part of the clutch ratchet is connected to the first inner ratchet.

10. The single point touch shower according to claim 7, wherein, the inlet passage comprises the hollow hole, an inlet cavity communicating with the hollow hole is formed between the body and the outlet mechanism.

11. The single point touch shower according to claim 7, wherein a mark is arranged on the body of the outlet terminal, the touch shower being configured so that the user touches the mark or an area surrounding the mark with a single point to cause the outlet terminal swings relative to the fixed unit.

* * * * *